United States Patent [19]

Schächter

[11] Patent Number: 4,502,217

[45] Date of Patent: Mar. 5, 1985

[54] SHAVING INSTRUMENT

[76] Inventor: Friedrich Schächter, Draschestrasse 31, A-1232 Vienna, Austria

[21] Appl. No.: 333,858

[22] PCT Filed: Apr. 10, 1981

[86] PCT No.: PCT/AT81/00007

§ 371 Date: Dec. 9, 1981

§ 102(e) Date: Dec. 9, 1981

[87] PCT Pub. No.: WO81/02864

PCT Pub. Date: Oct. 15, 1981

[30] Foreign Application Priority Data

Apr. 10, 1980 [AT] Austria ..... 1946/80

[51] Int. Cl.[3] ..... B26B 21/14

[52] U.S. Cl. ..... 30/82; 30/83

[58] Field of Search ..... 30/58, 59, 60, 60.5, 30/61–63, 74.1, 77, 81–83

[56] References Cited

U.S. PATENT DOCUMENTS 875,130 12/1907 Stern ..... 30/83
999130 11/1976 CAX .
2,349,252 5/1944 Douglass ..... 30/62 X
2,572,367 10/1951 Mills ..... 30/77 X
2,591,280 4/1952 Muros ..... 30/62
3,040,430 6/1962 Randolph ..... 30/60.5 X

FOREIGN PATENT DOCUMENTS 925278 5/1973 Canada .
985890 3/1976 Canada .
999130 11/1976 Canada .

*Primary Examiner*—James M. Meister
*Assistant Examiner*—Douglas D. Watts
*Attorney, Agent, or Firm*—Toren, McGeady and Stanger

[57] ABSTRACT

Shaving instrument having a guard bar (6) arranged spacedly in front of the blade cutting edge and extending parallel to the latter. The guard bar (6), in its surface area coming into contact with the skin, is provided with small projections, for example, file-type or rasp-type teeth (12,13) which protrude from the surface of the guard bar and are preferably arranged in two or more rows extending parallel to the blade cutting edge (26), and which have sharp edges (16,17) which act in the same direction as the blade cutting edge (26).

8 Claims, 12 Drawing Figures

SHAVING INSTRUMENT

BACKGROUND OF THE INVENTION

The invention relates to a shaving instrument having at least one razor blade which is firmly clamped between a base part made of plastics material and a cover part provided with a glide surface which faces the skin and ends at a predetermined distance from the cutting edge of the blade, and having a guard bar arranged in front of the blade cutting edge, the guard bar having a surface area which comes into contact with the skin and is aligned at a predetermined distance parallel to the cutting edge.

The quality of the shaving instrument not only depends on the exact position of the blade cutting edge relative to the guard bar, but also on the effectiveness of the elements on the guard bar which stretch the skin. These elements not only have the purpose of preventing skin creases from forming when the shaving instrument is guided in an unaccustomed direction which may cause unexpected injuries, but also of lifting up the hairs of the beard in front of the blade cutting edge so that they can be cut close to the roots.

The invention is based on the novel finding that such stretching elements can be manufactured with sharp edges by plastic deformation with the displacement of portions of the surface area of the guard bar, when the material of the guard bar is metal. Therefore, the basic concept of the invention is to manufacture the guard bar of metal and to combine it with one of the two parts clamping the razor blade. As a result, it is possible to select not only the most suitable material for the parts clamping the blades and for the guard bar, but also the most favorable manufacturing method. Accordingly, the object of providing an optimum shaving instrument with respect to its effectiveness and its manufacture is achieved thereby that the guard bar is composed of metal wire and its stretching elements acting in the same direction as the blade cutting edge project above the surface of the guard bar and are formed with sharp edges by plastic deformation and displacement of portions of the surface area of the guard bar, the guard bar at its ends being provided with legs which form an angle with the guard bar and are maintained in fixed position without play in one of the two parts clamping the blade.

Another comfort in handling resides in that the opening between the guard bar and the blade permits the unimpaired passage of cut hairs and soap because the lugs or stops keeping the guard bar spaced away are located outside of the effective range of the cutting edge.

The invention further relates to advantageous embodiments of such instruments.

BRIEF DESCRIPTION OF THE DRAWING

In the drawing, the subject matter of the invention is illustrated with the aid of an exemplifying embodiment.

DETAILED DESCRIPTION OF THE INVENTION

Figure 1:
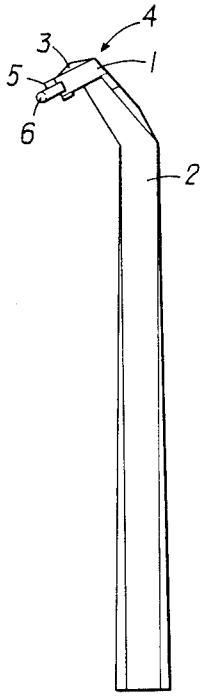
FIGS. 1 and 2 show a side view and a top view of the shaving instrument.
Figure 2:
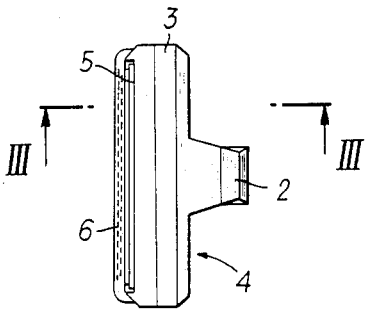
Figure 3:
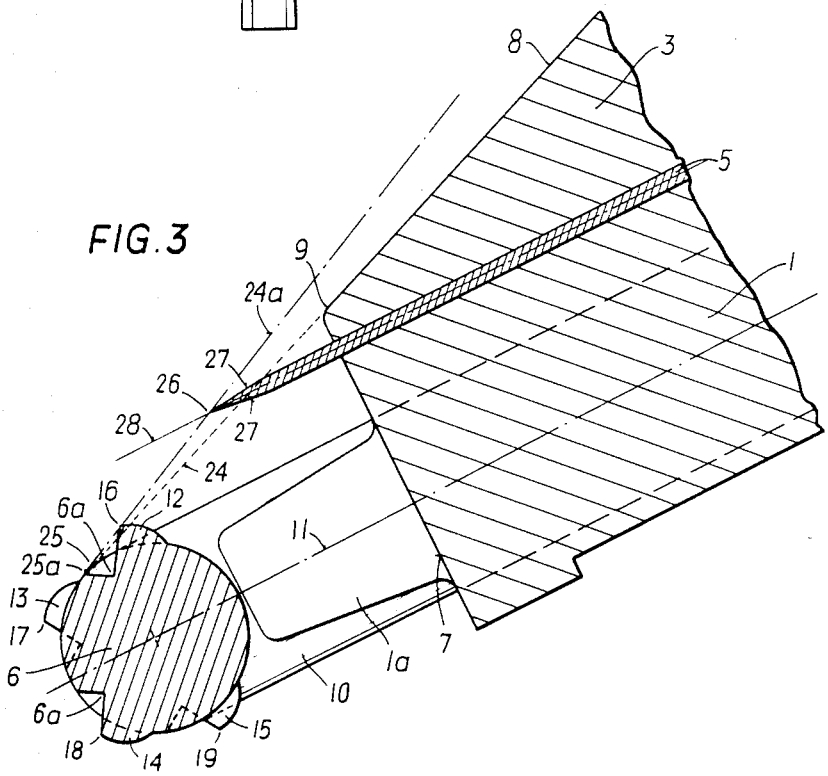
FIG. 3 shows a section along the line III—III of FIG. 2.
Figure 4:
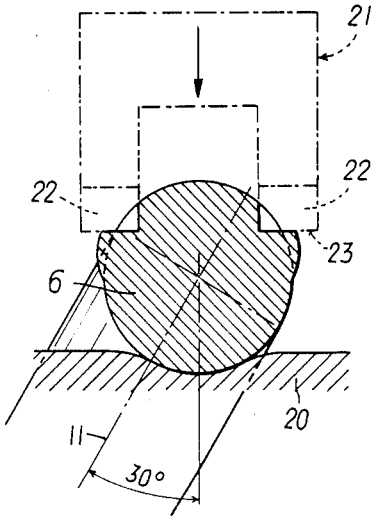
FIGS. 4 to 7 show stages of the manufacture of the teeth on the guard bar in sectional and top views, the sections of FIGS. 4 and 6 being taken along the lines IV—IV of FIG. 5 and VI—VI of FIG. 7, respectively and the dot-dash lines in FIG. 4 illustrating a tool for forming the teeth.
Figure 6:
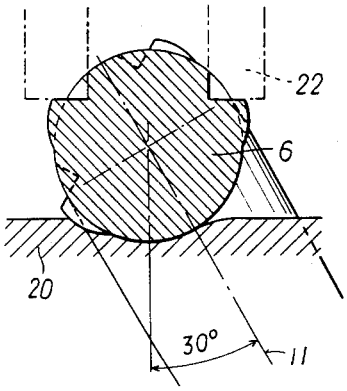
Figure 5:
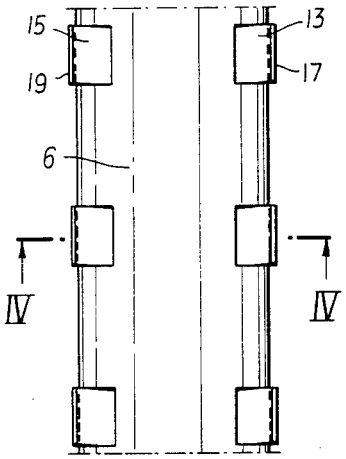
Figure 7:
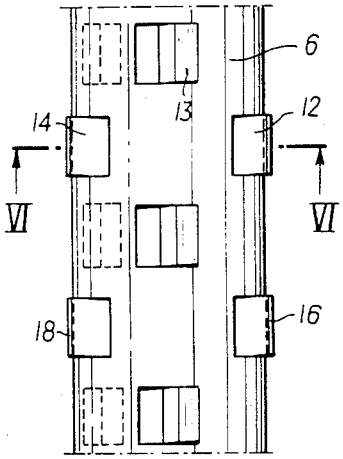
Figure 8:
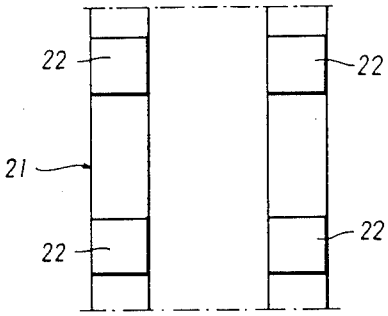
FIG. 8 shows a bottom view of the instrument.

The instrument in accordance with the invention has a blade holder which in its totality is denoted by reference numeral 4 and is composed of a base part 1 with a handle 2 molded to the base part 1 in one piece and a cover 3. The razor blade 5 is firmly clamped between base part 1 and cover 3 and cannot be exchanged. For protection, a guard bar 6 is provided which is supported by the base part 1. The front side of the base part 1 and the cover 3 form a front face 7 which, together with a glide surface 8 of the cover 3, forms a front edge 9.

The blade 5 protrudes beyond the front face 7. The guard bar 6 has at its ends legs 10 which form an angle with the guard bar 6 and are inserted into recesses of the base part and are maintained in fixed position in these recesses without play. For exactly maintaining the distance of the guard bar 6 from the front face 7, lugs 1*a* are provided at the base part 1 in close proximity to the legs. The quard bar is inserted into the blade holder 4 in such a way that its legs extend parallel to the center plane 28 of the blade 5, and its surface area coming into contact with the skin extends parallel to the cutting edge 26 of the blade.

In the illustrated example, the guard bar 6 has four rows of teeth provided on stretching elements 12, 13, 14, 15 arranged symmetrically to the center plane 11 of the guard bar and the legs 10. However, the rows of teeth do not always have to be arranged symmetrically, and, further, the number of rows of teeth may deviate from the number four. Although the rows of teeth 14 and 15 are of less importance for the shaving action of the instrument, it is useful to arrange these rows of teeth because they make it possible that the guard bar 6 can be inserted in the base part 1 without having to check whether the rows of teeth are in fact located on the side facing the blade 5. The teeth are formed by coining and have sharp edges 16,17,18,19 which extend parallel to the axis of the guard bar.

The positions of the rows of teeth are selected in such a way that at least one of them is located on that surface portion of the guard bar 6 which faces the blade. This portion is defined by a line 25*a* with which a tangential plane 24*a* extending through the blade cutting edge 26 contacts the surface of the guard bar. An improved embodiment results in that another row of teeth is arranged in front of this line of contact at the guard web 6.

The manufacture of the teeth is illustrated in FIGS. 4 to 7. The guard bar 6 is placed on a support 20 in such a way that the center plane 11 includes an angle of approximately 30° with the direction of movement of the tool 21. The tool 21 includes punches 22 which are arranged in two rows and coin a plurality of symmetrically arranged teeth 13, 15 on the guard bar 6. Subsequently, the guard bar 6 is turned, so that its center plane 11 again includes an angle of 30° with the direction of movement of the tool, however, the inclination being opposite as compared to the first coining procedure. Simultaneously, the guard bar 6 has been moved axially, so that the teeth 12,14 produced by the tool are offset relative to the teeth 13,15 of the previously formed row of teeth.

The punches 22 do not have to be prismatic and they do not have to have the end face 23 perpendicular to the moving direction of the tool 21. The tool as illustrated forms teeth whose sharp edges extend parallel to the rows of teeth. Each tooth projects over its entire length uniformly above the surface of the guard bar 6. A tengential plane of the guard bar 6 extending through the front edge 9 contacts the guard bar along the line of contact 25. The cutting edge 26 of the blade 5 is to have a certain position relative to the tangential plane 24. The cutting edge may project up to 0.12 mm over the tangential plane 24 or recede by up to 0.03 mm from it. The glide surface 8 is preferably located in the tangential plane 24. The sharp edges 16,17 of the rows of teeth arranged in front of and behind the line of contact 25 should preferably be located in the tangential plane 24. Finally, for achieving the object of the invention, the distance of the guard bar 6 from the cutting edge 26 and from the front face 7 also pays a role. Useful results are obtained when the distance between the line of contact 25 from the blade cutting edge is between 1.0 and 1.8 mm, for example, 1.2 to 1.6 mm.

Good shaving results could be achieved with instruments which are described in further detail below. The guard bar 6 had a circular cross-section with a diameter of 1.2 to 2.2 mm. The guard bars were provided with four rows of teeth arranged symmetrically to the center plane 11. The sharp edges of the teeth extended parallel to the rows of teeth and the latter extended parallel to the longitudinal axis of the guard bar and, thus, also to the cutting edge 26 of the blade. The lengths of the sharp edges of the teeth varied between 0.3 and 1.0 mm. They each projected by their entire lengths above the surface of the guard bar, this distance measuring between 0.03 and 0.12 mm. The tooth spaces within one row were of a size of about 1.0 mm. The teeth of adjacent rows were offset. The distance between the rows is selected between 0.5 and 1.5 mm. Especially favorable results were obtained with distances which measured between 0.7 and 1.0 mm.

The center plane 28 defined by the sides 27 which form the cutting edge 26 of the razor blade 5 and the tangential plane 24 included an angle of between 14° and 28°.

Excellent shaving results were obtained with the following instruments. The guard bar 6 had a diameter of 1.59±0.01 mm and was provided with rows of teeth which had lengths of 36 mm and were composed of twenty-two teeth. The length of the blade cutting edge was 37 mm.

The length of the individual sharp edges of the teeth was 0.5 mm. The teeth had within each row a spacing of 1.0 mm. The spacing of the tooth roots **6*a* forming pits or recesses was about 1 mm between the teeth 12 and 14, or 13 and 15, respectively. The four rows of teeth provided were staggered approximately 30° on the circumference of the guard bar and were arranged symmetrically to the center plane 11 of the latter. The sharp edges of the teeth protruded uniformly about 0.07 mm from the surface of the guard bar. The center plane 28 of the blade cutting edge 26 and the tangential plane 24 included an angle of 20°. By the selection of the adequate manufacturing tolerances, it was achieved that the blade cutting edge 26 projected above the tangential plane 24 by only 0.05 to 0.09 mm. The sharp edges 16 of the teeth 12 were located in the tangential plane 24. The distance of the line of contact 25*a* from the cutting edge 26** was 1.4 mm.

The arrangement and the dimensions were selected in such a way that the loads occurring during the normal use and life span of the instrument did not cause any displacement or permanent deformation of the individual parts. By providing an appropriately stiff construction, it was possible to ensure that, prior to, during and after the use of the instrument, the front edge 9, the cutting edge 26 and the lines of contact **25,25*a*** were located between two imaginary parallel planes having a distance from one another of at most 0.05 mm, preferably 0.03 mm.

Figure 9:
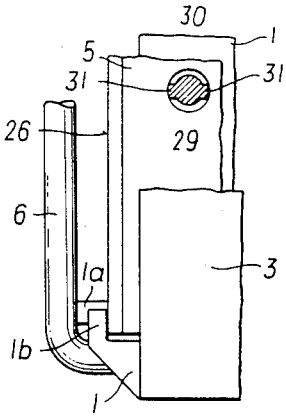
FIG. 9 shows a detail on a large scale.

FIG. 9 shows an embodiment of the shaving instrument by way of example on a larger scale. The base part 1 has a lug **1*a* near each end of the cutting edge 26 for the guard bar 6 and also a lug 1*b* for the cutting edge 26 of the blade 5. The blade 5 has holes 29 which are in alignment with bores in the base part when the blade is in the correct position. The bores are smaller than the holes 29 and positioned in exact distance from the lugs 1*a*. The cover part 3 has rivet pins which extend without contact through the holes 29 of the blade and fit snugly in the bores of the base part 1. After the blade has been moved forwardly by means of a magnet and the blade rests against the lugs 1*b*, riveting is performed and the blade 5 is thereby permanently clamped between the base part and the cover with the cutting edge at the exact distance from the guard bar 6 and, due to the expansion of the rivet pins in the bores of the base part, the cover is exactly positioned as well. Due to the fact that the lugs 1*a* and 1*b*** are provided on the same part of the blade holder, this distance between the guard bar and the blade cutting edge has very small tolerances.

Another way of ensuring this distance between the cutting edge and the guard bar 6 without using the lugs **1*b* resides in manufacturing the holes 29 of the blade exactly in relation to the cutting edge 26. In this case the rivet pins 30 are utilized for the exact positioning of the cutting edge 26. The diameter of the rivet pins is smaller than that of the holes 29 in the blade, however, the pins are provided with two oppositely located ribs 31 which are arranged in the direction perpendicular to the cutting edge 26. The cylindrical generated surface circumscribing these ribs 31 has a diameter which is approximately 0.01 mm smaller than that of the blade holes 29. The diameters of the bores in the base part 1 can be equal to or be smaller by up to 0.02 mm than the diameters of the holes 19. Instead of the two ribs as illustrated, it is also possible to provide three ribs distributed uniformly over the circumference. A centering procedure results from a minute expansion of the pins during the riveting operation, so that the holes in the blade are in exact alignment with the bores in the base part 1. Of course, the lugs 1*b*** are omitted in these cases.

It is essential that the alignment of the guard bar 6 relative to the cutting edge 26 is effected by means which are provided together on one of the two parts of the blade holer, either on the base part 1 or the cover part 3.

In order to ensure that the lugs **1*a* are not deformed by excessive press fix when the legs of the guard bar are inserted into the blade holder the legs of the guard bar 6 fit smoothly without play into the recesses provided in the base part 1 for their reception, these recesses which are not illustrated in the drawing are arranged in the blade holder and are provided with two spacedly arranged wall surfaces extending parallel to the plane 11 of the guard bar. The legs 10 of the guard bar 6** are calibrated parallel to the same plane to a dimension which is approximately 0.02 mm smaller than the smallest diameter of the leg permissible with respect to tolerance.

The invention is not limited to the embodiment illustrated in the drawing.

In the embodiment, a wire of stainless steel was used for the guard bar 6, however, other metallic materials can be used. The shape of the teeth and the rows of the teeth may vary. The cross-section of the guard bar 6 may deviate from the circle shape. However, it is useful to construct convexly the surface area coming into contact with the skin.

The handle of the instrument is formed in one piece with the blade holder or is connected to the latter. However, a construction may also be selected wherein a loosely insertable blade is clamped in the blade holder in the known manner.

However, the instrument can also be used without a blade either for massaging the facial skin or for adjusting the hairs of the beard prior to shaving.

Figure 10:
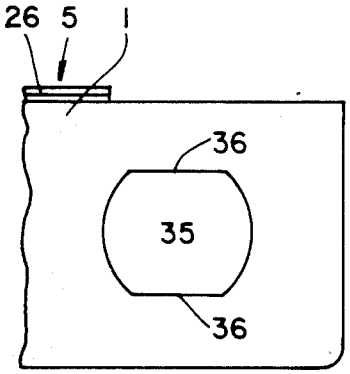
FIG. 10 shows recesses formed in the base part.

FIG. 10 shows recesses 35 which open toward the web or guard bar 6. The recesses 35 have wall surfaces 36 arranged at a distance from one another and extending parallel to the cutting edge 26 of the razor blade 5. These recesses 35 serve to receive without play the legs 10 of the guard bar 6.

Figure 11:
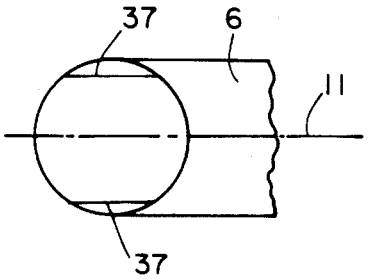
FIGS. 11 and 12 show details of the leg of the web.
Figure 12:
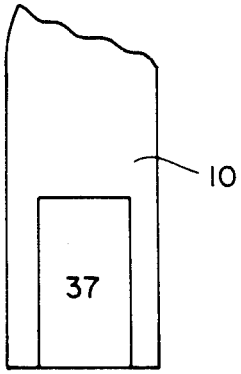

FIGS. 11 and 12 show plane surfaces 33 formed in the legs 10 of the guard bar 6 which are produced by pressing and extend parallel to the center plane 11 of the guard bar 6. The surfaces 37 of the legs 10 have a distance from one another which is approximately 0.02 mm smaller than the smallest wire diameter admissible with respect to tolerance.

I claim:

1. A shaving instrument comprising a base part of plastics material, at least one razor blade having a cutting edge placed on said base part, a cover part attached to said base part so that said razor blade is clamped between said base part and said cover part, said cover part having a glide surface facing the skin to be shaven and away from said base part and ending at a distance from said cutting edge of said razor blade, a guard bar coming into contact with the skin and arranged spaced from and parallel to said cutting edge of said razor blade, wherein said guard bar is composed of a calibrated wire whose nominal diameter ranges from between 1.2 and 2.2 mm, said guard bar carrying at its ends legs arranged at an angle to said guard bar and connected without play to one of said base part and said cover part, at least two lugs connected to one of said base part and said cover part near said legs of said guard bar, said lugs serving for maintaining the position of said guard bar relative to said cutting edge of said razor blade, wherein one of said base part and said cover part defines recesses opening toward said guard bar, said recesses receiving without play said legs of said guard bar, said recesses each having two wall surfaces arranged at a distance from one another and extending parallel to said cutting edge of said razor blade, and wherein said legs of said guard bar have plane surfaces produced by pressing and extending parallel to the center plane of said guard bar, said surfaces of said legs having a distance from one another which is approximately 0.02 mm smaller than the smallest wire diameter admissible with respect to tolerance.

2. A shaving instrument comprising a base plate of plastics material, at least one razor blade having a cutting edge placed on said base part, a cover part attached to said base part so that said razor blade is clamped between said base part and said cover part, said cover part having a slide surface facing the skin to be shaven and away from said base part and ending at a distance from said cutting edge of said razor blade, a guard bar of metal wire coming into contact with the skin and arranged spaced from and parallel to said cutting edge of said blade, wherein said guard bar is composed of a calibrated wire whose nominal diameter ranges from between 1.2 and 2.2 mm, said guard bar carrying at its ends legs arranged at an angle to said guard bar and maintained in fixed position without play on one of said base part and said cover part, said guard bar provided with a plurality of elements with sharp edges for stretching the skin acting in the same direction as said cutting edge of said razor blade, at least two lugs connected to one of said base part and said cover part near said legs of said guard bar, said lugs serving for maintaining the position of said guard bar relative to said cutting edge of said razor blade, wherein one of said base part and said cover part defines recesses opening toward said guard bar, said recesses receiving without play said legs of said guard bar, said recesses each having two wall surfaces arranged at a distance from one another and extending parallel to said cutting edge of said razor blade, and wherein said legs of said guard bar have plane surfaces produced by pressing and extending parallel to the center plane of said guard bar, said surfaces of said legs having a distance from one another which is approximately 0.02 mm smaller than the smallest wire diameter admissible with respect to tolerence.

3. A shaving instrument comprising a base part of plastics material, at least one razor blade having a cutting edgge placed on said base part, a cover part attached to said base part so that said razor blade is clamped between said base part and said cover part, said cover part having a glide surface facing the skin to be shaven and away from said base part and ending at a distance from said cutting edge of said razor blade, a guard bar coming into contact with the skin and arranged spaced from and parallel to said cutting edge of said razor blade, said guard bar carrying at its ends legs arranged at an angle to said guard bar and connected without play to one of said base part and said cover part, at least two lugs connected to one of said base part and said cover part near said legs of said guard bar, said lugs servng for maintaining the position of said guard bar relative to said cutting edge of said razor blade, wherein said cover part includes a front edge arranged parallel to and spaced away from said cutting edge of said razor blade, wherein the location of said cutting edge of said razor blade ranges from a point 0.12 mm in front of to a point 0.03 mm behind a tangential plane of said guard bar extending through said front edge, wherein said cutting edge of said razor blade is formed by sides of said razor blade converging toward one another, said sides defining a center plane which includes an angle of 14° to 28° with said tangential plane of said guard bar extending through said front edge, and wherein said glide surface of said cover part facing away from said blade is situated in said tangential plane, the width of said glide surface being greater than the distance of said front edge from said cutting edge of said razor blade.

4. A shaving instrument comprising a base part of plastics material, at least one razor blade having a cutting edge placed on said base part, a cover part attached to said base part so that said razor blade is clamped between said base part and said cover part, said cover part having a slide surface facing the skin to be shaven and away from said base part and ending at a distance from said cutting edge of said razor blade, a guard bar of metal wire coming into contact with the skin and arranged spaced from and parallel to said cutting edge of said blade, said guard bar carrying at its ends legs arranged at an angle to said guard bar and maintained in fixed position without play on one of said base part and said cover part, said guard bar provided with a plurality of elements with sharp edges for stretching the skin acting in the same direction as said cutting edge of said razor blade, at least two lugs connected to one of said base part and said cover part near said legs of said guard bar, said lugs serving for maintaining the position of said guard bar relative to said cutting edge of said razor blade, wherein said cover part includes a front edge arranged parallel to and spaced away from said cutting edge of said razor blade, wherein the location of said cutting edge of said razor blade ranges from a point 0.12 mm in front of to a point 0.03 mm behind a tangential plane of said guard bar extending through said front edge, wherein said cutting edge of said razor blade is formed by sides of said razor blade converging toward one another, said sides defining a center plane which includes an angle of 14° to 28° with said tangential plane of said guard bar extending through said front edge, and wherein said glide surface of said cover part facing away from said blade is situated in said tangential plane, the width of said glide surface being greater than the distance of said front edge from said cutting edge of said razor blade.

5. The shaving instrument according to claim 3 or 4, wherein said center plane and said tangential plane include an angle of 18° to 24°.

6. A shaving instrument comprising a base part of plastics material, at least one razor blade having a cutting edge placed on said base part, a cover part attached to said base part so that said razor blade is clamped between said base part and said cover part, said cover part having a slide surface facing the skin to be shaven and away from said base part and ending at a distance from said cutting edge of said razor blade, a guard bar of metal wire coming into contact with the skin and arranged spaced from and parallel to said cutting edge of said blade, said guard bar carrying at its ends legs arranged at an angle to said guard bar and maintained in fixed position without play on of one base part and said cover part, said guard bar provided with a plurality of elements with sharp edges for stretching the skin acting in the same direction as said cutting edge of said razor blade, at least two lugs connected to one of said base part and said cover part near said legs of said guard bar, said lugs serving for maintaining the position of said guard bar relative to said cutting edge of said razor blade, wherein said stretching elements are arranged on said guard bar in at last one row extending parallel to the axis of said guard bar, said stretching elements having file-like or rasp-like teeth with sharp edges, said sharp edges acting in the same direction as said cutting edge of said razor blade, wherein pits are provided in the surface of said guard bar in front of each of said teeth, the front faces of said teeth extend directly into said pits and constitute one of the walls of said pits.

7. A shaving instrument comprising a holding part of plastics material having a glide surface facing the skin to be shaven and a guard bar of metal coming into contact with the skin, said guard bar connected to said holding part, said guard bar provided with a plurality of elements with sharp edges for stretching the skin, wherein said stretching elements having file-like or rasp-like teeth with sharp edges, and wherein pits are provided in the surface of said guard bar in front of each of said teeth, the front faces of said teeth extend directly into said pits and constitute one of the walls of said pits.

8. The shaving instrument according to claim 6 or 7, wherein the volume of each tooth projecting from the surface of said guard bar equals the volume of said pit located in front of said tooth.

* * * * *